US005215258A

United States Patent [19]

Jursich

[11] Patent Number: 5,215,258

[45] Date of Patent: Jun. 1, 1993

[54] ACTIVE SHOWER HEAD

[75] Inventor: Donald N. Jursich, Chicago, Ill.

[73] Assignee: Pollenex Corporation, Chicago, Ill.

[21] Appl. No.: 819,097

[22] Filed: Jan. 9, 1992

Related U.S. Application Data

[63] Continuation-in-part of Ser. No. 740,794, Aug. 6, 1991.

[51] Int. Cl.[5] ..... B05B 7/04

[52] U.S. Cl. ..... 239/394; 239/396; 239/428.5

[58] Field of Search ..... 239/425.5, 428.5, 390, 239/393, 394, 396, 225.1, 240, 242

[56] References Cited

U.S. PATENT DOCUMENTS

| | | | |
|---|---|---|---|
| 3,568,716 | 3/1971 | Heitzman | 239/99 X |
| 3,998,390 | 12/1976 | Peterson et al. | 239/394 |
| 4,043,511 | 8/1977 | Nakmura | 239/394 |
| 4,068,801 | 1/1978 | Leutheuser | 239/394 X |
| 4,322,292 | 3/1982 | Knox | 239/428.5 |
| 4,534,514 | 8/1985 | Aghnides | 239/428.5 |
| 4,903,897 | 2/1990 | Hayes | 239/394 |
| 5,111,994 | 5/1992 | Gonzalez | 239/428.5 |

*Primary Examiner*—Andres Kashnikow
*Assistant Examiner*—Kevin Weldon
*Attorney, Agent, or Firm*—Laff, Whitesel, Conte & Saret

[57] ABSTRACT

A dial shower head is adapted to be manually turned to select and designate one of a plurality of spray pattern heads. The spray pattern heads orbit a central point in the shower head as the dial turns. A rotor inside the shower head can spin the dial to discharge water through the designated spray pattern head as it orbits the central point. The shower head is especially attractive in areas where governments have restricted the allowable flow of water as a conservation matter since the orbiting head gives a sensation that a larger amount of water is being discharged.

10 Claims, 3 Drawing Sheets

ACTIVE SHOWER HEAD

This is a continuation-in-part of application Ser. No. 07/740,794 filed Aug. 6, 1991.

This invention relates to shower heads and more particularly to active shower heads having means for delivering a plurality of different patterns of shower water spray, anyone of which may be delivered with or without pulsation that is selected separately from the selection of the spray pattern.

One example of an active shower head with some of the described features is found in U.S. Pat. No. 3,998,390. Other patents with active shower heads are found in the following U.S. Pat. Nos.: 3,762,648; 3,801,019; 4,187,986; 4,190,207; 4,303,201; 4,398,669; and 4,588,130.

Various methods are used to flush a shower head (called an "active shower head" herein) with a pulsating stream of water so that there will be a massaging action upon the body of the user. There are a relatively large number of pieceparts in the shower head for accomplishing this action. These parts are subject to liming and thus to sometimes binding or otherwise ceasing to give the massaging action. The relatively large number of parts also results in a relatively expensive construction.

Another consideration goes to the pattern of spray that is delivered. For example, U.S. Pat. No. 3,998,390 shows a dial which may be turned to select one from among four different spray pattern shower heads, each giving a different spray pattern. Sometimes a person might want to select any of the plurality of spray patterns with either a pulsating or a non-pulsating delivery.

Another consideration goes to governmental rules and regulations as a matter of water conservation. Some states are now restricting the amount of water which may be delivered from any shower head. For example, a common requirement is that shower heads be constructed so that they will deliver no more than 2.5 gallons per minute. This relatively low rate of water flow is far less than some people wish to use.

Accordingly, an object of the invention is to provide a shower head with new and improved spray patterns. Here, an object is to optionally provide such spray patterns, either with or without a pulsating delivery.

Another object is to provide active shower heads with fewer parts, which can be manufactured at lower cost.

Yet another object of the invention is to provide shower heads which are less prone to liming problems.

Still another object of the invention is to meet governmental regulated restrictions on the rate of water flow while giving the user a psychological sensation of a much larger flow of water.

In keeping with an aspect of this invention, these and other objects are accomplished by a dial shower head which may be manually rotated to select or designate any one of a plurality of heads with different spray patterns. A rotor which is positioned within the shower head may be set into motion by a separate selector switch. When the rotor is set into motion, the entire dial rotates continuously through a full 360° with water issuing from the spray pattern head that is manually selected by rotation of the dial. This causes not only a pulsating sensation at any given location on the user's skin, but also distributes water over the user's body in a manner which simulates a much larger flow rate. When the rotor is turning, a pulsating spray is thus delivered from any one of the shower heads which may have been designated responsive to the manual dial setting.

A preferred embodiment of the invention is shown in the attached drawings, wherein.

Figure 1:
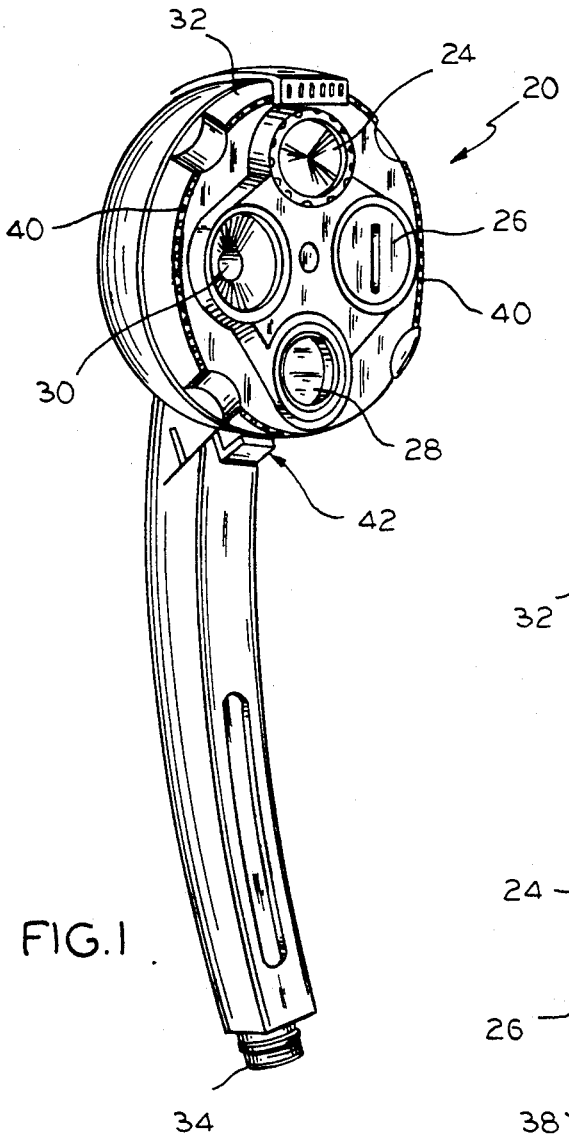
FIG. 1 is a perspective view of a hand held shower head which may be connected to a water supply via a rubber hose.
Figure 2:
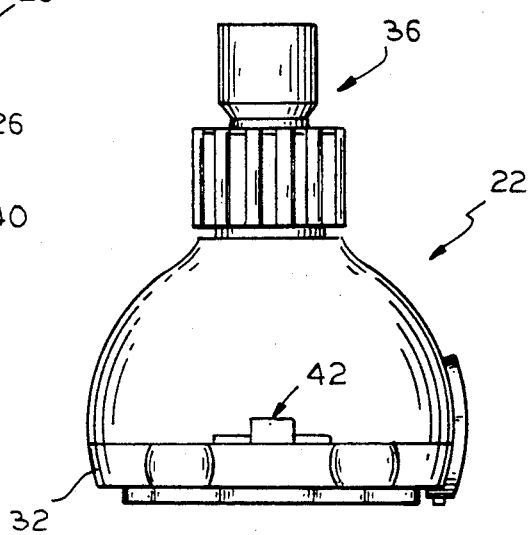
FIG. 2 is a side elevation of a wall mounted shower head connected directly to a plumbing pipe.
Figure 3:
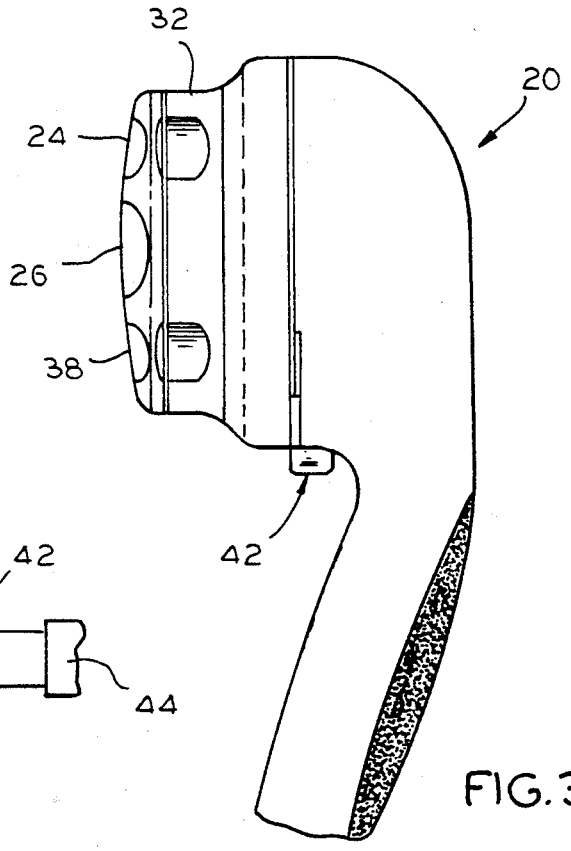
FIG. 3 is a schematic side view showing a spray head dial selector.

As shown in FIGS. 1, 2, and 3, a dial shower head 20, 22 has a plurality of separate spray pattern heads 24–30 which are built into a dial 32 that may be manually rotated to selectively place any one of them in front of a water issuing port, thereby designating that pattern of shower water. The two shower heads 20, 22 are the same, except that head 20 connects at 34 to a rubber hose, and may be hand held, while the shower head 22 connects at 36 to a plumbing pipe. The particular spray heads shown in FIG. 1 are those shown and described in U.S. Pat. No. 3,998,390, which may be consulted for more information about the construction of structures found in the prior art.

The inventive shower head provides an additional fine spray from apertures formed in a peripheral circle 40 around the circumference of the shower head so that the user may elect to be exposed to a gentle spray regardless of the principle spray pattern 24–30 that he may select by dial rotation. Many, if not most, people like this shower pattern since it is similar to the one which they have used the longest. Also, in addition to turning the dial in order to select a particular spray pattern, the user has a lever 42 which may be moved to the left, right, or center positions to select either a pulsating or non-pulsating spray from any designated spray pattern shower head and to select the fine spray issuing from circumferential holes 40.

The circumferential spray, or pulsation/non-pulsation selector lever 42 (FIG. 4) includes an arcuate rack of gear teeth 48 and a tab 44 for manipulating the lever on a pivot point 46. Meshing with the arcuate rack of gear teeth 48 is a pinion gear 50 having a water exit passage opening 52 therein. The pinion gear 50 ma rotate water exit hole 52 by 180° under an urging of the lever 42, in order to divert water into any one of three different water paths 54, 56, 58 which give a fine circumferential spray, a pulsating spray, or a non-pulsating spray, respectively.

Figure 5:
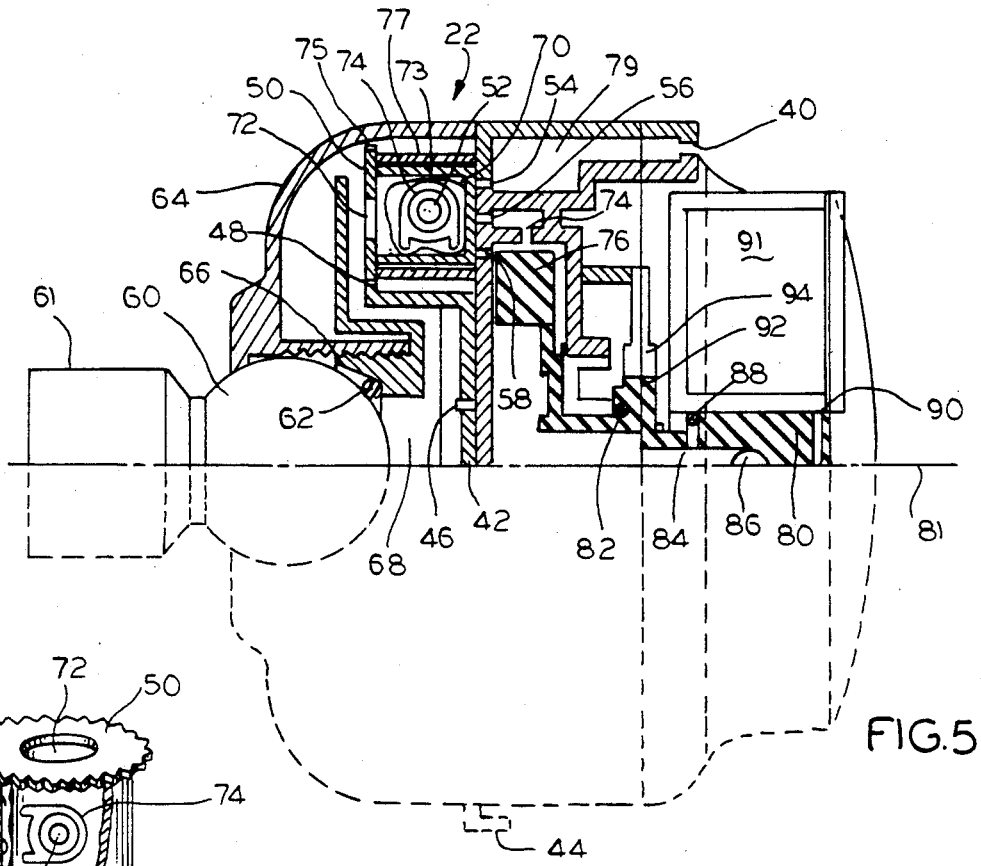
FIG. 5 is a side elevation view of the shower head with half of it shown in cross-section.

The shower head 22, seen in FIG. 5, is a wall mounted unit such as that shown in FIG. 2. The hand-held unit of FIGS. 1, 3 has substantially the same internal parts, construction, and operation that are shown in FIG. 2.

A swivel ball 60 (FIG. 5) provides a coupling for joining the shower head 22 to a plumbing pipe (not shown) at nipple 61. An O-ring 62 seals the swivel ball 60 to the shower head. An outer cover 64 joins the shower head 22 to the swivel ball 60 and tightens on threads 66 to hold it in place.

Beneath the swivel ball (FIG. 5), a water path 68 which begins at nipple 61, extends through ball 60, and path 68 to the pinion gear 50, and through opening 72 to chamber 70. The control lever arm 42 is pivoted at 46 and meshes with the pinion gear at 48.

Figure 4:
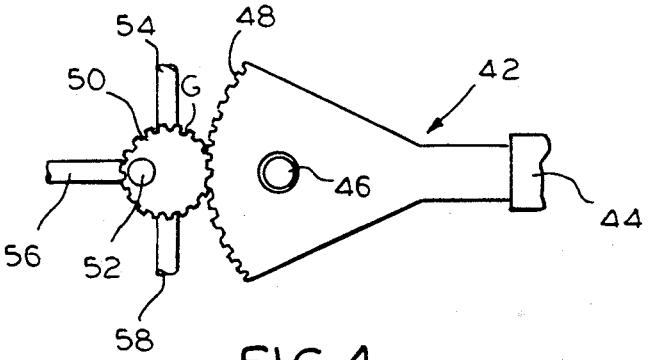
FIG. 4 is a plan view schematically showing the workings of the pulsating spray selector.
Figure 5A:
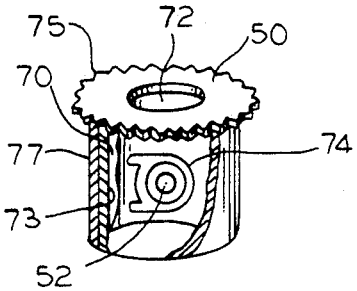
FIG. 5A is a perspective view of a pulsating spray selector which is taken from FIG. 5.

In FIG. 4, the pinion gear 50 is schematically shown as a simple disk with a hole in it; however, its actual construction is seen in FIG. 5A. The pinion gear 50 has, dependent from it, a somewhat cup or thimble shape 73 (FIG. 5A) with gear teeth 75 located around the crown of the cup or thimble shape in order to make contact with the arcuate rack of gear teeth 48. The cup or thimble shape 73 is enclosed within a cylinder 77 with a friction fit between confronting thimble or cup and cylinder walls. A water hole 52 enables water to exit chamber 70 through the walls of the both thimble or cup shape 73 and the cylinder 77. A compound O-ring 74 is embedded in the thimble wall and positioned between it and the wall of cylinder 77 in order to restrict the distribution of water flowing out of hole 52 to one of three specific holes (not shown) in cylinder 77. The water exiting hole 52 and a corresponding hole in cylinder 77 may pass through any one of the openings 54, 56, 58 (FIG. 5), depending upon the position of pinion gear 50 and, therefore, of the water hole 52.

Hence, the water may exit chamber 70 in any one of several different ways, depending upon the position of the pinion gear 50. One way is through port 54 which leads to the chamber 79 and a circumferential ring of holes 40 that give a fine mist spray in order to provide a gentle shower that covers the body of the user.

Means are provided for rotating dial 32 (FIG. 5) in response to movement of lever 42 in order to give a pulsating sensation to the user. More particularly, when the pinion gear 50 is rotated to a position which delivers water through hole 56, the water is redirected at right angles (with respect to an axis of turbine rotation) through hole 74 and against flat sides of blades 76 of the turbine, thus turning the turbine rotor 80 about an axis 81 of rotation. The rotor 80 and dial 32 are a unitary piecepart; therefore, they rotate as a unit. The turbine rotor 80 is mounted on ball bearings 82.

The turbine rotor has a central passageway 84 which terminates in a hole 86 projecting at a right angle therefrom. The O-rings 88, 90 seal off the area above and below hole 86 in order to restrict the flow of water to a specific spray pattern shower head which has been designated by rotation of the dial 32. If the pinion gear 50 is positioned to open path 56, the rotor is turning in response to the stream of water issuing from hole 74, and striking the broad side of turbine blade 76. The turning rotor 80 causes water to spray out of the spinning hole 86 to strike the selected spray head 91 that was designated by a manual rotation of dial 32. Thus, a stream of water issuing from the selected spray head 91 moves across the user's skin, giving a pulsating sensation at any given spot. Spray head 91 may be any one of the spray heads 24–30 (FIG. 1) that has been selected and designated by rotating dial 32.

When pinion gear 50 is rotated to a position which delivers water through hole 58, the water is directed onto the top of the blades 76, thus striking them in a direction which does not turn the turbine rotor 80. More particularly, when water enters the turbine chamber via path 58, the force of water is not directed against the flat side of blade 76 and in a direction which causes it to turn. A ratchet 92 and pawl 94 allows the turbine rotor 80 to rotate in only one direction under the urging of water emitted through hole 74. Pawl 94 prevents the rotor from rotating in an opposite direction under any urging by water emitted through hole 58. To the extent that water issuing through hole 58 does strike the blade 76, it strikes in a direction which presses the stationary rotor against the pawl. Since the rotor 80 is not turning, the water passing through hole 86 simply fills a chamber and exits through the selected spray head 91 in a steady, non-pulsating stream (i.e. since dial 32 is standing still, the user does not feel a stream of water move across his skin).

Figure 6:
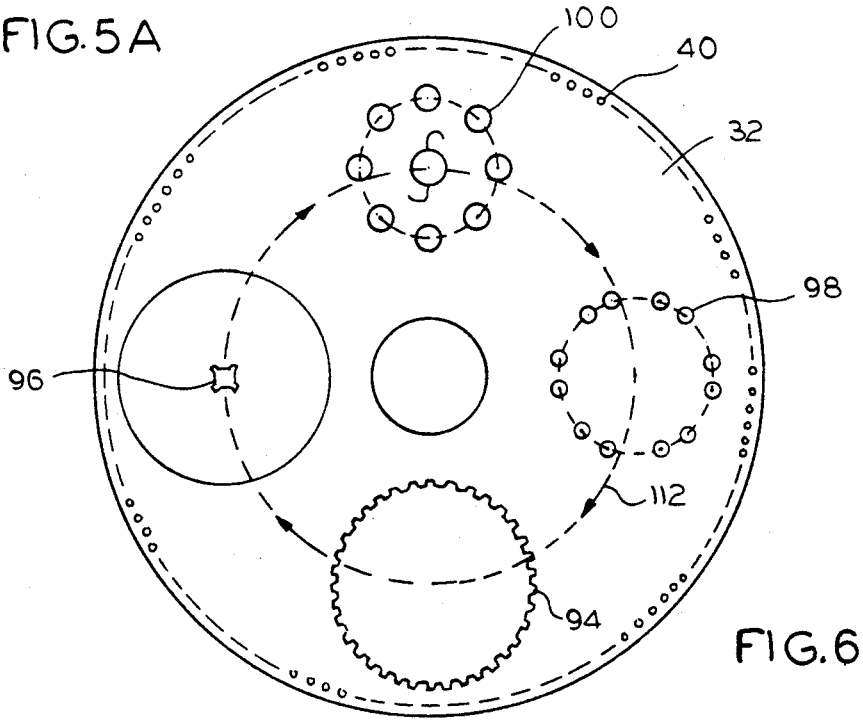
FIG. 6 is a layout of the four shower spray heads for giving different spray patterns.

FIG. 6 shows a number of spray patterns which may be selected by turning the dial 32. These patterns range from a fine mist at 94 to a single large and coarse gushing stream at 96. An inbetween spray pattern 98 is the one thought to be the most likely to be used with a pulsating spray of water.

Figure 8:
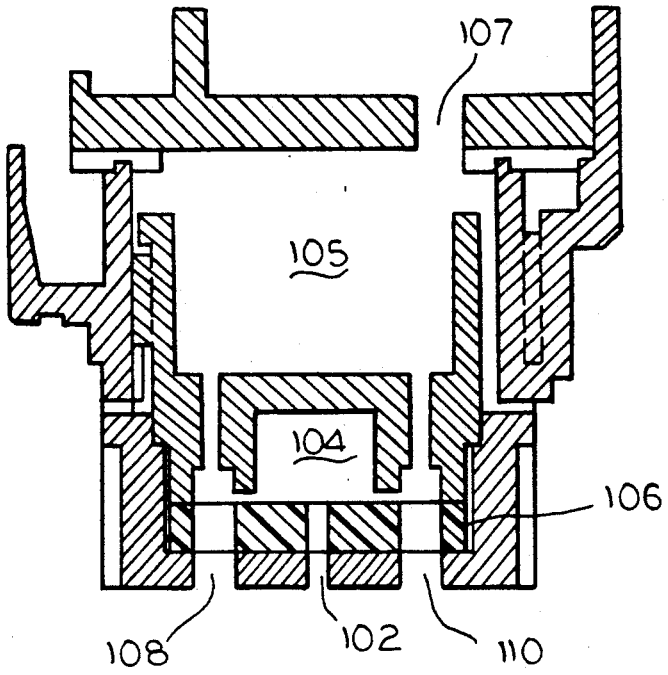
FIG. 8 is a cross-section taken along line 8—8 of FIG. 7.
Figure 7:
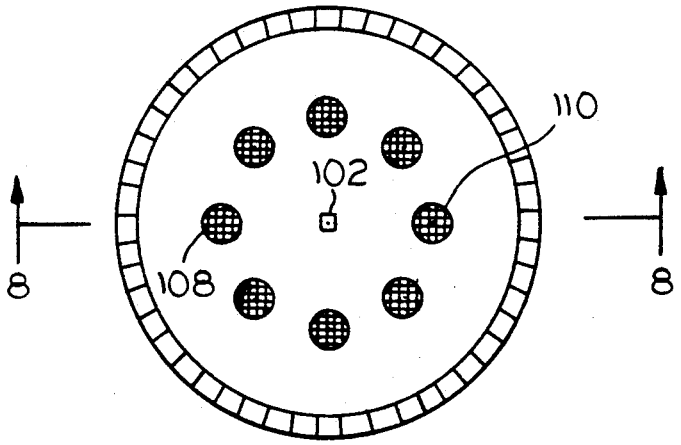
FIG. 7 is a plan view of an aerator spray head.

The pattern at 100 is an aerator which is thought to be a most suitable spray for shampooing. FIG. 7 shows a face plate of an aerator having an air intake hole 102 and water outlet holes 108, 110. This aerator is different from the standard kitchen faucet aerator since air cannot enter the top of the aerator. Instead the aerator (FIGS. 7 and 8) has a central air intake 102 which draws ambient air into an air chamber space 104 above a screen 106. Water enters into a water chamber 105 via hole 107. The air mixes with the water in the area above and around screen 106, before it exits through the holes such as 108, 110.

In operation, assume by way of example, that spray pattern 98 (FIG. 6) was designated by manually turning dial 32. Further, assume that the lever arm 42 (FIG. 5) is moved to cause water to flow through path 56. Rotor 80 turns and the designated spray head 98 orbits along path 112, thus causing it to move smoothly around 360°, in FIG. 6.

Those who are skilled in the art will readily perceive how to modify the invention. Therefore, the appended claims are to be construed to cover all equivalent structures which fall within the true scope and spirit of the invention.

The invention claimed is:

1. An active shower head comprising a dial having a plurality of different spray pattern heads therein which can be selected and designated by manually turning said dial, selector means for selectively applying water through any designated one of said spray pattern heads with either a pulsating or a non-pulsating sensation, a turbine rotor that rotates said dial, and said rotor having a tube with an aperture which turns with said rotor for discharging water through said designated spray pattern head as said dial and rotor turn.

2. The shower head of claim 1 wherein said selector means comprises a lever arm terminating in an arcuate rack of gear teeth, a pinion gear engaged by said rack and rotated through a limited angle responsive to movement of said lever arm, and a plurality of water paths which are selectively fluidized responsive to a position selected by rotation of said pinion gear, one of said water paths delivering a stream of water for turning said rotor and for discharging said stream through said aperture to the selected and designated spray pattern shower head.

3. The shower head of claim 2 and a circumferential pattern of holes in a periphery of said shower head, a second of said water paths delivering a stream of water to said circumferential pattern of holes.

4. The shower head of claim 2 and means responsive to a selection of a third of said water paths for delivering a steady stream of water to the selected spray pattern head while said rotor and dial remain stationary.

5. A shower head comprising a chamber containing a turbine rotor which is turned about an axis of rotation by a stream of water flowing through said shower head, an aperture associated and turning with said rotor for directing said stream of water at an angle substantially transverse to said axis of rotation as said rotor turns, and shower means which rotates around an orbit responsive to said rotor turning for delivering water from said aperture through a shower head outlet which rotates around said orbit under the urging of said rotor.

6. The shower head of claim 5 and means for stopping the rotation of said rotor and said shower means so that said shower head outlet delivers water as a steady stream.

7. The shower head of claim 6 and means for selecting between a plurality of water paths, one of said water paths feeding water in a direction which turns said turbine rotor and the other of said water paths feeding water in a direction which does not turn said turbine rotor.

8. The shower head of claim 7 and valve means which may be operated to select any one of said water paths, and a dial for selectively designating one of a plurality of spray patterns of holes for discharging water flowing in said selected water path.

9. The shower head of claim 8 wherein at least one of said patterns is a circumferential pattern of spray holes surrounding said dial.

10. The shower head of any one of the claims 1, 5, or 8 and aerator means comprising a face area for delivering shower water from a plurality of holes, an air intake in said face area for drawing air into a chamber above a screen, said air in said chamber mixing with said water before being delivered through said screen and from said plurality of holes.

* * * * *